US005588702A

United States Patent [19]

Litwin

[11] Patent Number: 5,588,702

[45] Date of Patent: Dec. 31, 1996

[54] GARDEN ROCKING-CHAIR

[76] Inventor: Stanislaw Litwin, Przybyslawice 96, 63-400 Ostrow Wielkopolski, Poland

[21] Appl. No.: 519,766

[22] Filed: Aug. 28, 1995

[30] Foreign Application Priority Data

Jul. 28, 1995 [PL] Poland ..... 309835

[51] Int. Cl.[6] ..... A63G 9/00

[52] U.S. Cl. ..... 297/277; 297/184.16; 297/172; 297/452.13; 297/452.2; 297/440.1

[58] Field of Search ..... 297/184.16, 184.15, 297/184.1, 273, 258.1, 272.1, 452.18, 412.19, 452.2, 463.1, 440.1, 440.14, 440.24, 452.13, 135, 170–174, 277; 472/118

[56] References Cited

U.S. PATENT DOCUMENTS

| | | | |
|---|---|---|---|
| 101,295 | 3/1870 | Mellen | 297/184.16 |
| 201,561 | 3/1878 | Simonson | 297/184.16 X |
| 343,965 | 6/1886 | McElroy | 297/184.16 X |
| 446,659 | 2/1891 | Bunker | 297/277 X |
| 1,023,620 | 4/1912 | Burge | 297/172 X |
| 3,528,657 | 9/1970 | Krupsky | 472/118 |
| 3,834,757 | 9/1974 | Krupsky | 297/277 |
| 4,809,724 | 3/1989 | Fuser | 297/184.16 X |

FOREIGN PATENT DOCUMENTS

| | | | |
|---|---|---|---|
| 2437182 | 4/1980 | France | 297/184.1 |

*Primary Examiner*—Milton Nelson, Jr.
*Attorney, Agent, or Firm*—Richard E. Jenkins, P.A.

[57] ABSTRACT

A novel recreational rocking-chair for use in summer resorts and the like. The chair is constructed from a tubular frame comprising a base portion with four legs supporting an upstanding C-shaped support arm. A rigid lounge portion is pivotally suspended from the upper end of the C-shaped support arm to provide for pivotal movement of the lounge portion by the user.

2 Claims, 3 Drawing Sheets

GARDEN ROCKING-CHAIR

BACKGROUND OF THE INVENTION

The present invention relates to a rocking-chair which is a recreational piece of furniture, designed specially for use in summer resorts and the like.

The design of a prior art rocking-chair that is already known is a garden sofa designed for several persons. This sofa consists of a tubular rack. The rack is formed with four legs stably connected with each other. There is a seat with a support hanging on the tubular rack on chains. The seat is made of tubular frames, on which is a spring base covered with a spongy material stretched thereon. The sofa also consists of a tangent roof formed by waterproof material stretched on the tubular frame.

This prior art garden sofa is complicated to assemble and disassemble and furthermore due to its great weight and overall dimensions, it requires at least two people to be moved from one location to another.

SUMMARY OF THE INVENTION

The garden rocking-chair of the invention is formed of a light, functional, easy to assemble and disassemble construction of a one-person garden rocking-chair, which can be transported to any place in the area by one person.

The essence of the invention is a new construction of a garden rocking-chair mounted on a base of tubular framework.

The rocking-chair, according to the invention, is a light, functional one-person construction of a recreational piece of furniture, easy to assemble and disassemble, and capable of movement by one person.

Some of the objects of the invention having been stated hereinabove, other objects will become evident as the description proceeds, when taken in connection with the accompanying drawings as best described hereinbelow.

BRIEF DESCRIPTION OF THE DRAWINGS

The rocking-chair according to the invention is shown in the drawings on which.

DETAILED DESCRIPTION OF THE INVENTION

Figure 1:
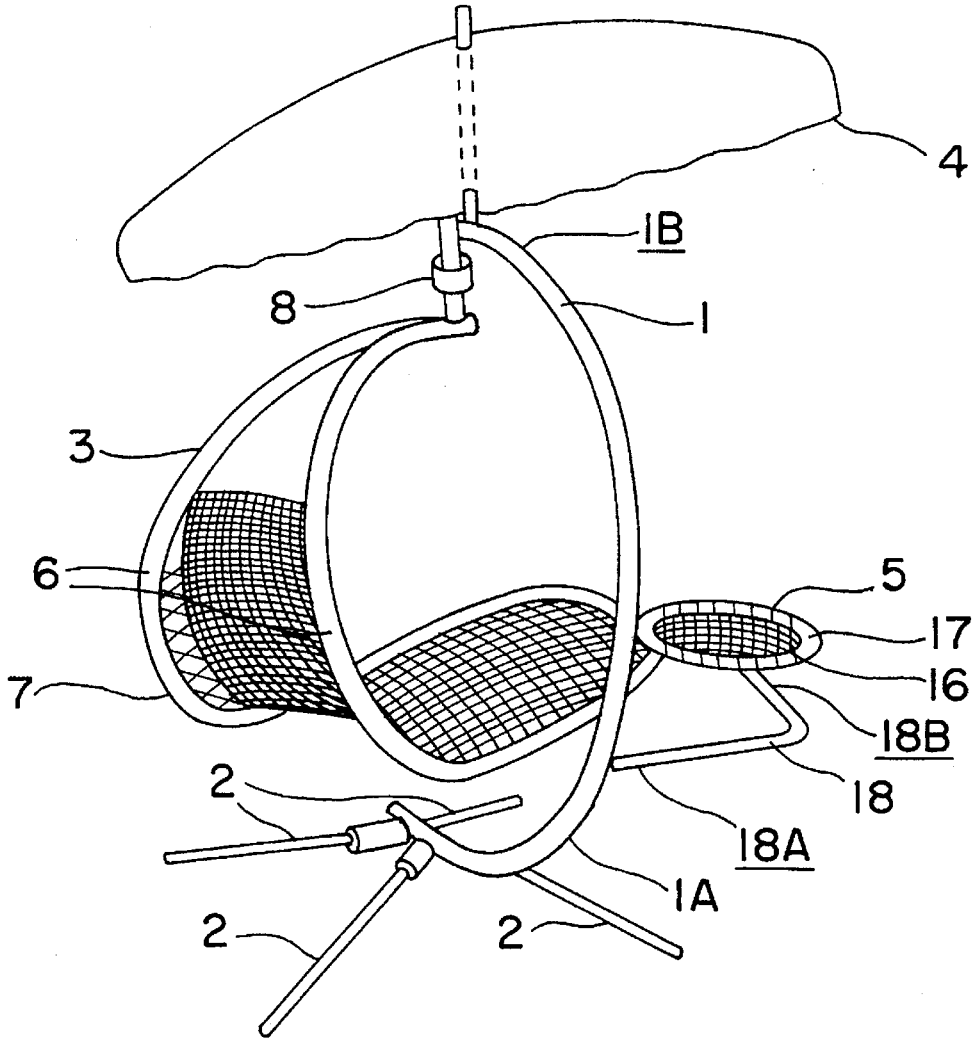
FIG. 1 represents a perspective view of the novel garden rocking-chair of the present invention.

With reference to FIG. 1, shown is a garden rocking-chair comprising of a support bracket 1 with legs 2 and a pendulously attached pallet 3, according to the invention, having frame 6 with a tubular cross-section and with a material 7 stretched on it.

Figure 2:
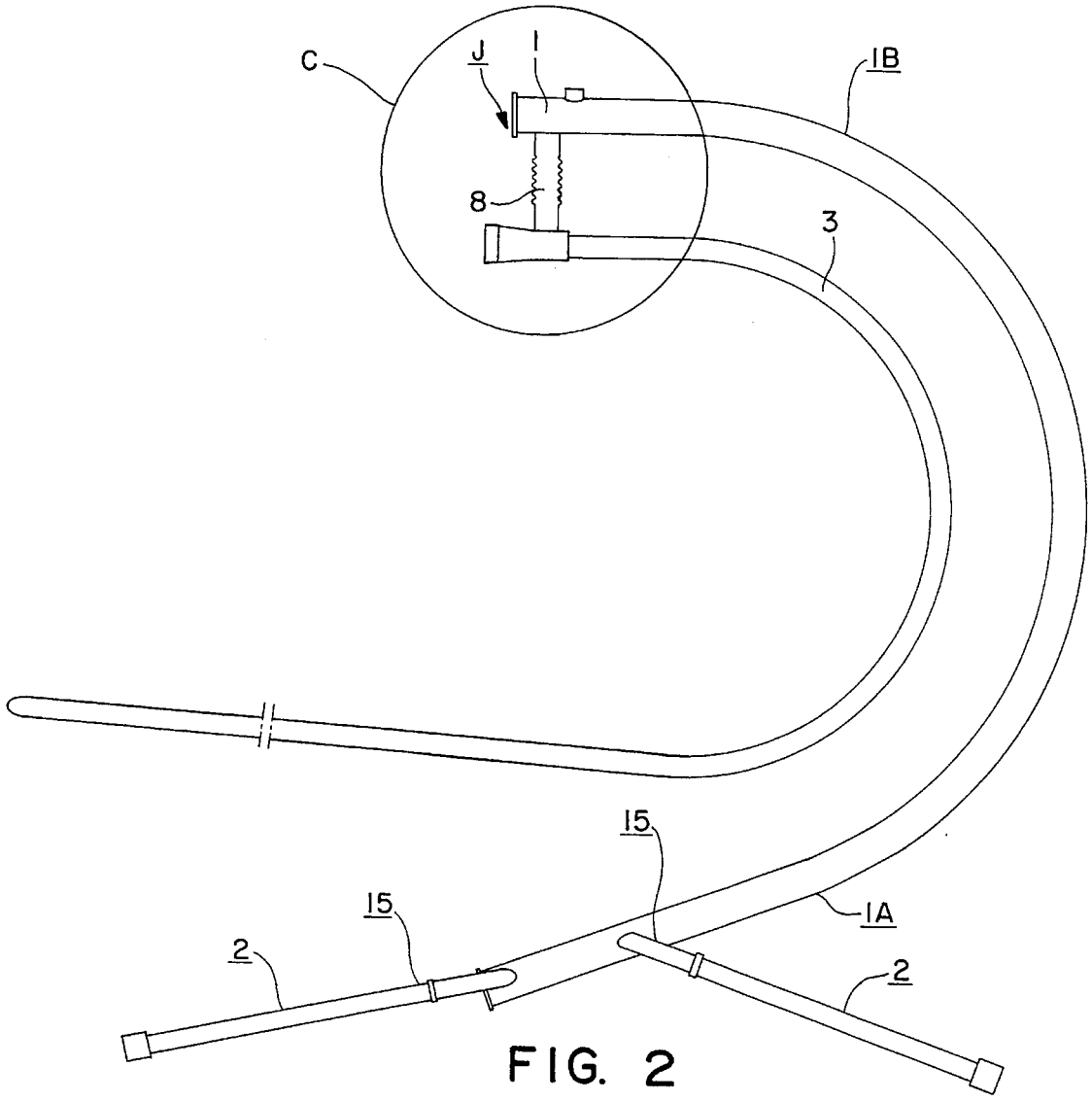
FIG. 2 represents a side elevation view of the novel garden rocking-chair.

FIG. 2 is a cross-sectional view along the plane defined by support bracket 1 from FIG. 1, but with pallet 3 rotated approximately 90° so that it is aligned with support bracket 1, better to illustrate the relationship of pallet 3 and support bracket 1. Sling 8 is hanging on support bracket 1 by joint J (see exploded view in FIG. 3). Joint J consists of eye bolt 9 covered with cylindrical, metallic shield 10 and attached to support bracket 1, and of intermediate link 11 and hook 12 covered with a cylindrical shield 13 welded onto frame 6 of the pallet 3.

Figure 3:
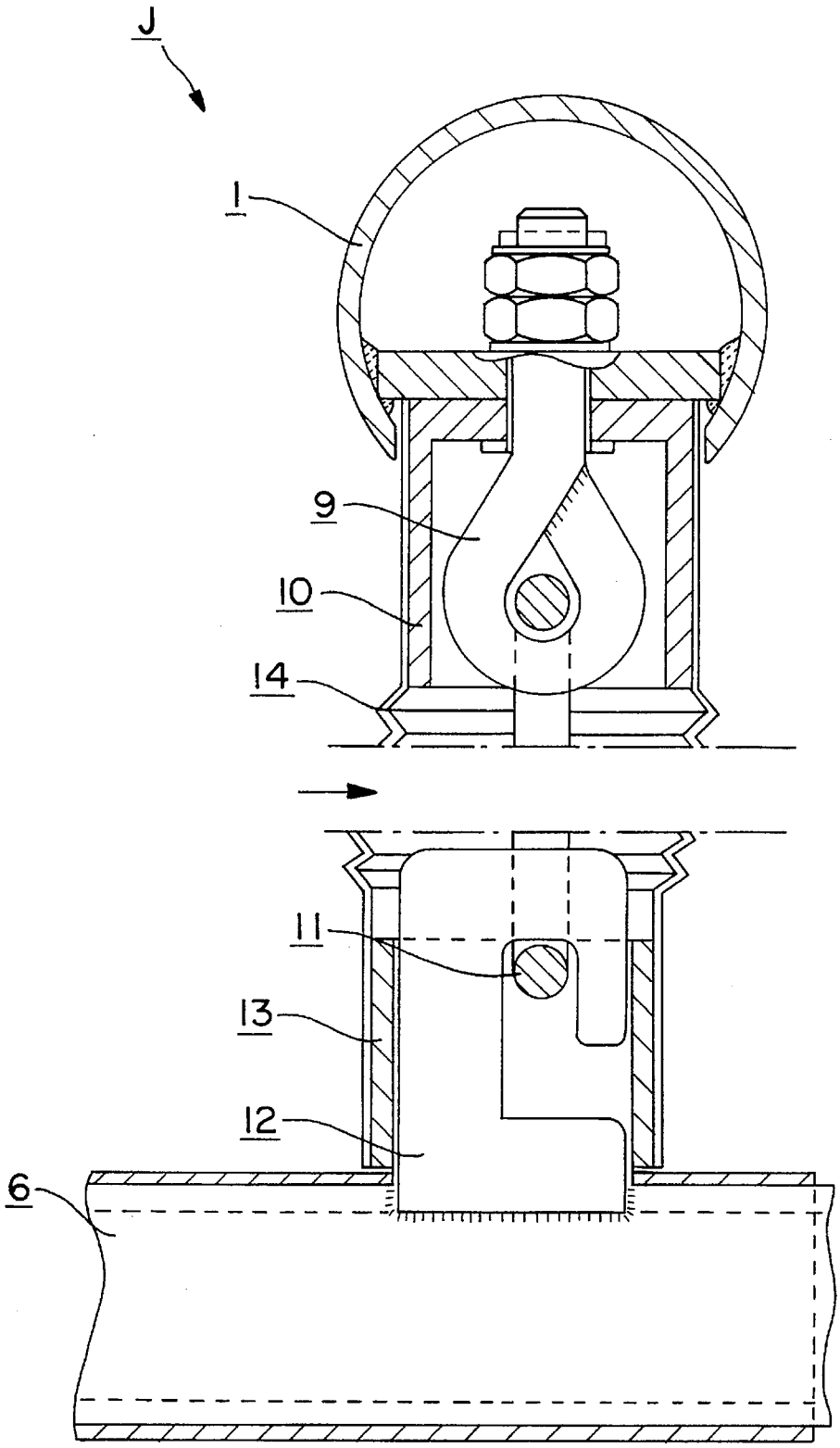
FIG. 3 is an exploded vertical sectional view of the joint assembly portion (contained in circle C of FIG. 2), wherein the chair is pivotally connected to the support frame.

An elastic, concertina jacket 14 is put on the cylindrical shields 10, 13 (see FIG. 3)

Tubular legs 2 of the rocking-chair are slidably fixed and secured by screws in four tubular elements 15 (see FIG. 2) welded onto the lower part 1A of the bracket support 1.

Additionally, tangent umbrella 4 is separably attached to support bracket 1 in its upper part 18. On lower part 1A, at a definite height above the bottom level portion of the pallet 3 cross-sectioned arm 18 is separably attached at its first end 18A. At its second end 18B, arm 18 is terminated by the table-top 5. The table-top 5 has a tubular frame 16 with a material 17 stretched upon it.

It will be understood that various details of the invention may be changed without departing from the scope of the invention. Furthermore, the foregoing description is for the purpose of illustration only, and not for the purpose of limitation-the invention being defined by the claims.

What is claimed is:

1. A rocking-chair, with a bracket support having an upper part, having a lower part with legs, and having a pallet that is pendulously attached and that has a bottom level portion, characterized in that the pallet is formed of a tubular frame with a material stretched upon it and is suspended on the bracket support by a lifting joint that comprises an eye-bolt covered with a cylindrical, metallic shield attached to the bracket support, an intermediate link and a hook covered with a cylindrical shield welded onto the frame of the pallet, and the cylindrical shields are covered by an elastic bellows jacket, and furthermore the legs of the rocking-chair are slidably fixed together and secured by screws into four tubular elements welded onto the lower part of the bracket support.

2. A rocking-chair characterized by a bracket support having an upper part, having a lower part with legs, and having a pallet that is pendulously attached and that has a bottom portion, characterized in that the pallet is formed of a tubular frame with a material stretched upon it and is suspended on the bracket support by a lifting joint that comprises an eye-bolt covered with a cylindrical, metallic shield attached to the bracket support, an intermediate link and a hook covered with a cylindrical shield welded onto the frame of the pallet, and the cylindrical shields are covered by an elastic bellows jacket, and furthermore the legs of the rocking-chair are slidably fixed together and secured by screws into four tubular elements welded onto the lower part of the bracket support, and furthermore the rocking chair has a tangent umbrella separably attached to the upper part of the bracket support and on a definite height above the bottom level portion of the pallet and has a grading arm with a first end separably attached to the bracket support and with a second end terminating in a table top, and the table top comprises a tubular frame with a material stretched upon it.

* * * * *